US008281594B2

(12) United States Patent
Wiebe

(10) Patent No.: US 8,281,594 B2
(45) Date of Patent: Oct. 9, 2012

(54) FUEL INJECTOR FOR USE IN A GAS TURBINE ENGINE

(75) Inventor: David J. Wiebe, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 531 days.

(21) Appl. No.: 12/555,134

(22) Filed: Sep. 8, 2009

(65) Prior Publication Data

US 2011/0056206 A1 Mar. 10, 2011

(51) Int. Cl.
*F02C 1/00* (2006.01)

(52) U.S. Cl. ..... 60/733; 60/740

(58) Field of Classification Search ..... 60/733, 60/734, 739, 740, 746–748, 752; 431/8–10, 431/174–176, 181–185, 187, 278, 280–281, 431/284–285, 350–353
See application file for complete search history.

(56) References Cited

U.S. PATENT DOCUMENTS

| | | | | |
|---|---|---|---|---|
| 3,266,552 | A | 8/1966 | Denis | |
| 4,216,908 | A * | 8/1980 | Sakurai et al. | 239/132.3 |
| 4,858,538 | A * | 8/1989 | Kuypers et al. | 110/264 |
| 4,887,962 | A * | 12/1989 | Hasenack et al. | 110/263 |
| 5,297,391 | A | 3/1994 | Roche | |
| 5,454,221 | A | 10/1995 | Loprinzo | |
| 5,487,659 | A * | 1/1996 | Eroglu et al. | 431/350 |
| 5,687,572 | A | 11/1997 | Schrantz et al. | |
| 5,826,429 | A | 10/1998 | Beebe et al. | |
| 6,047,550 | A | 4/2000 | Beebe | |
| 6,192,688 | B1 | 2/2001 | Beebe | |
| 6,775,984 | B2 * | 8/2004 | Lavie et al. | 60/740 |
| 6,868,676 | B1 | 3/2005 | Haynes | |
| 7,007,477 | B2 * | 3/2006 | Widener | 60/737 |
| 8,070,483 | B2 * | 12/2011 | Zalman | 431/160 |
| 2009/0071159 | A1 * | 3/2009 | Parker et al. | 60/747 |

OTHER PUBLICATIONS

U.S. Appl. No. 12/180,657, filed Jul. 28, 2008, Ritland et al., 17 pages.
U.S. Appl. No. 12/233,903, filed Sep. 19, 2008, Fox et al., 29 pages.
U.S. Appl. No. 12/477,397, filed Jun. 3, 2009, Fox et al., 41 pages.
U.S. Appl. No. 12/431,302, filed Apr. 28, 2009, Wiebe et al., 29 pages.

* cited by examiner

*Primary Examiner* — Phutthiwat Wongwian

(57) ABSTRACT

A fuel injector in a combustor apparatus of a gas turbine engine. An outer wall of the injector defines an interior volume in which an intermediate wall is disposed. A first gap is formed between the outer wall and the intermediate wall. The intermediate wall defines an internal volume in which an inner wall is disposed. A second gap is formed between the intermediate wall and the inner wall. The second gap receives cooling fluid that cools the injector. The cooling fluid provides convective cooling to the intermediate wall as it flows within the second gap. The cooling fluid also flows through apertures in the intermediate wall into the first gap where it provides impingement cooling to the outer wall and provides convective cooling to the outer wall. The inner wall defines a passageway that delivers fuel into a liner downstream from a main combustion zone.

20 Claims, 7 Drawing Sheets

FUEL INJECTOR FOR USE IN A GAS TURBINE ENGINE

This invention was made with U.S. Government support under Contract Number DE-FC26-05NT42644 awarded by the U.S. Department of Energy. The U.S. Government has certain rights to this invention.

FIELD OF THE INVENTION

The present invention relates to a fuel injector for use in a gas turbine engine, and, more particularly, to a fuel injector that distributes fuel into a combustor downstream from a main combustion zone of the combustor.

BACKGROUND OF THE INVENTION

In gas turbine engines, fuel is delivered from a fuel source to a combustion section where the fuel is mixed with air and ignited to generate hot combustion products defining working gases. The working gases are directed to a turbine section. The combustion section may comprise one or more stages, each stage supplying fuel to be ignited.

SUMMARY OF THE INVENTION

In accordance with a first embodiment of the present invention, a fuel injector is provided for use in a combustor apparatus of a gas turbine engine. The fuel injector extends through an opening formed in a liner and into an inner volume of the liner and comprises an outer wall, an intermediate wall, and an inner wall. The outer wall defines an interior volume therein and includes at least one opening formed therein. At least a portion of the outer wall is located in the inner volume of the liner. The intermediate wall is disposed in the outer wall interior volume and is spaced from the outer wall such that a first gap is formed between the outer wall and the intermediate wall. The intermediate wall defines an internal volume and includes at least one aperture formed therein. The inner wall is disposed in the intermediate wall internal volume and is spaced from the intermediate wall such that a second gap is formed between the intermediate wall and the inner wall. The second gap receives cooling fluid that cools the fuel injector. The inner wall defines a passageway therein that receives fuel and delivers the fuel to the inner volume of the liner downstream from a main combustion zone defined by the liner. The cooling fluid in the second gap provides convective cooling to the intermediate wall as it flows within the second gap. The cooling fluid also flows through the at least one aperture in the intermediate wall into the first gap where the cooling fluid provides impingement cooling to the outer wall and provides convective cooling to the outer wall as it flows within the first gap.

The outer wall, the intermediate wall, and the inner wall may each be concentric with one another and the first and second gaps may comprise cylindrical-shaped gaps extending in a radial direction.

A distal end of the inner wall may define a fuel injection port in fluid communication with the passageway. The fuel injection port delivers the fuel to the inner volume of the liner.

The outer wall may comprise a plurality of film cooling holes formed therein, the film cooling holes permitting cooling fluid flowing in the first gap to flow therethrough to provide film cooling to an outer surface of the outer wall.

At least one of the film cooling holes may be angled in a radial direction so as to release cooling fluid in a direction that includes a component in the radial direction.

The film cooling holes may be formed in the outer wall at locations radially inwardly from a radial location where the fuel injector extends through the opening in the liner.

An inner surface of the outer wall and/or an outer surface of the intermediate wall may include a plurality of turbulating structures that turbulate the cooling fluid flowing in the first gap.

The fuel injector may include a valve that controls a flow of the cooling fluid into the second gap.

In accordance with a second embodiment of the invention, a fuel injection system is provided for use in a combustor apparatus of a gas turbine engine. The fuel injection system delivers fuel into an inner volume of a liner at a location downstream from a main combustion zone defined in the inner volume of the liner. The fuel injection system comprises a fuel manifold that receives fuel to be distributed into the inner volume of the liner and a plurality of fuel injectors in fluid communication with the fuel manifold. The fuel injectors extend from the fuel manifold through corresponding openings formed in the liner and distribute the fuel from the fuel manifold into the inner volume of the liner downstream from the main combustion zone. Each of the fuel injectors comprises an outer wall, an intermediate wall, and an inner wall. The outer wall defines an interior volume therein and includes at least one opening formed therein. At least a portion of the outer wall is located in the inner volume of the liner. The intermediate wall is disposed in the outer wall interior volume and is spaced from the outer wall such that a first gap is formed between the outer wall and the intermediate wall. The intermediate wall defines an internal volume and includes at least one aperture formed therein. The inner wall is disposed in the intermediate wall internal volume and is spaced from the intermediate wall such that a second gap is formed between the intermediate wall and the inner wall. The second gap receives cooling fluid that cools the fuel injector. The inner wall defines a passageway therein that receives the fuel from the fuel manifold and delivers the fuel to the inner volume of the liner downstream from the main combustion zone. The cooling fluid in the second gap provides convective cooling to the intermediate wall as it flows within the second gap. The cooling fluid also flows through the at least one aperture in the intermediate wall into the first gap where the cooling fluid provides convective cooling to the outer wall as it flows within the first gap.

In accordance with a third embodiment of the invention, a combustor apparatus is provided for use in a gas turbine engine. The combustor apparatus comprises a liner comprising an inner volume, wherein a portion of the inner volume defines a main combustion zone. The combustor apparatus further comprises a flow sleeve for receiving compressed air, the flow sleeve positioned radially outward from the liner. The combustor apparatus still further comprises a first fuel injection system associated with the flow sleeve and a first fuel supply structure in fluid communication with a source of fuel for delivering fuel from the source of fuel to the first fuel injection system. The combustor apparatus additionally comprises a second fuel injection system associated with the liner downstream from the main combustion zone, and a second fuel supply structure in fluid communication with the source of fuel for delivering fuel from the source of fuel to the second fuel injection system. The second fuel injection system provides fuel into the inner volume of the liner at a location downstream from the main combustion zone. The second fuel injection system comprises a fuel manifold that receives fuel from the second fuel supply structure and a plurality of fuel injectors in fluid communication with the fuel manifold. The fuel injectors extend through corresponding openings in the liner into the inner volume of the liner. The fuel injectors distribute the fuel from the fuel manifold into the inner volume of the liner downstream from the main combustion zone. Each of the fuel injectors comprises an outer wall, an intermediate wall, and an inner wall. The outer wall defines an interior volume therein and includes at least one opening formed therein. At least a portion of the outer wall is located in the inner volume of the liner. The intermediate wall is disposed in the outer wall interior volume and is spaced from the outer wall such that a first gap is formed between the outer wall and the intermediate wall. The intermediate wall defines an internal volume and includes at least one aperture formed therein. The inner wall is disposed in the intermediate wall internal volume and is spaced from the intermediate wall such that a second gap is formed between the intermediate wall and the inner wall. The second gap receives cooling fluid that cools the fuel injector. The inner wall defines a passageway therein that receives the fuel from the fuel manifold and delivers the fuel to the inner volume of the liner downstream from the main combustion zone. The cooling fluid in the second gap provides convective cooling to the intermediate wall as it flows within the second gap. The cooling fluid also flows through the at least one aperture in the intermediate wall into the first gap where the cooling fluid provides convective cooling to the outer wall as it flows within the first gap.

The combustor apparatus may further comprise a plurality of seal members, one for each fuel injector. Each seal member is associated with a respective one of the openings in the liner through which the fuel injectors extend. The seal members limit leakage through the openings in the liner.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
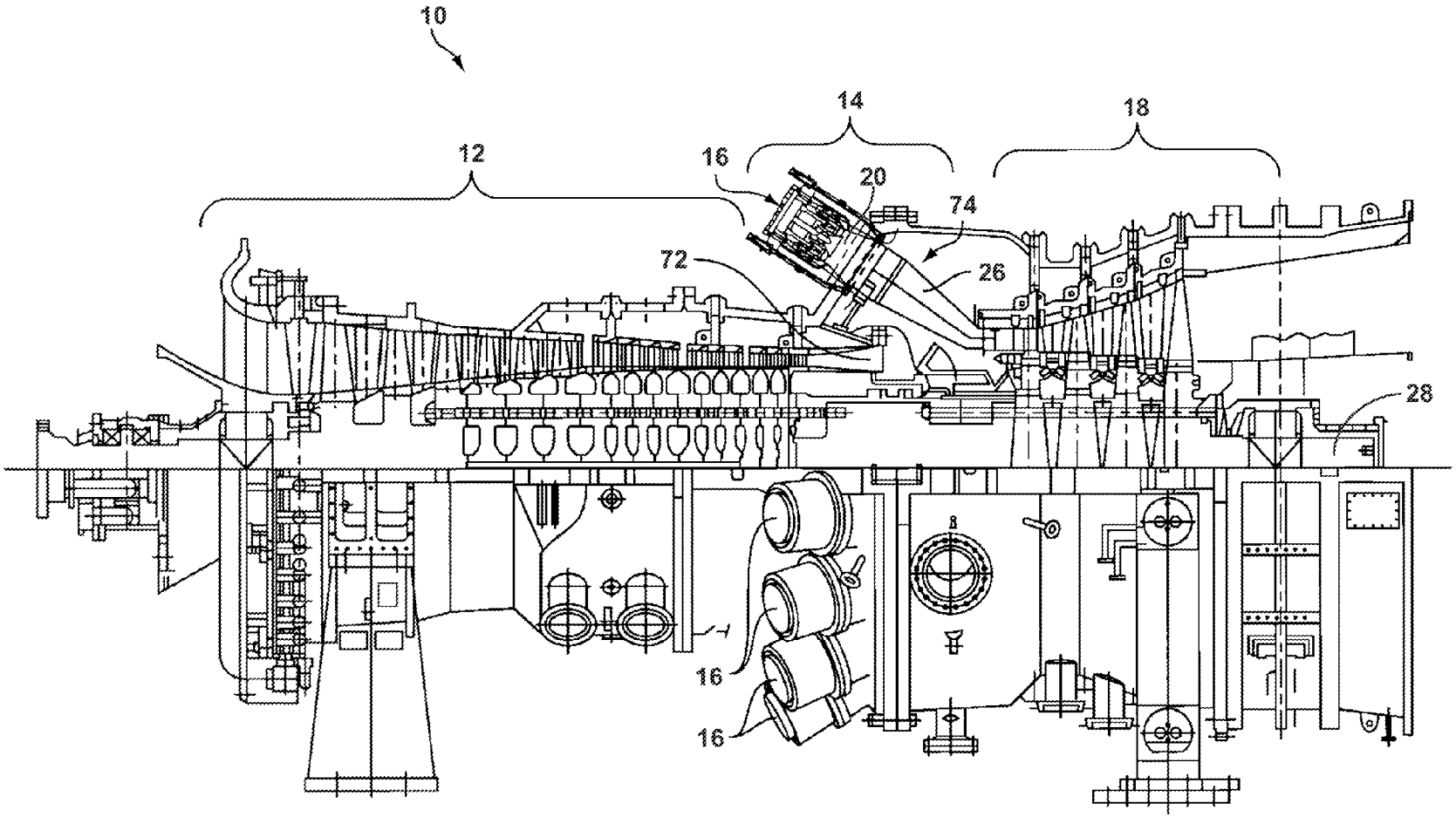
FIG. 1 is a sectional view of a gas turbine engine including a plurality of combustor apparatuses according to an embodiment of the invention.

Referring to FIG. 1, a gas turbine engine 10 is shown. The engine 10 includes a compressor section 12, a combustion section 14 including a plurality of combustor apparatuses 16, and a turbine section 18. The compressor section 12 inducts and pressurizes inlet air which is directed to the combustor apparatuses 16 in the combustion section 14, where the compressed air is mixed with fuel and burned to create hot combustion products defining working gases. The combustion products in each of the combustor apparatuses 16 then flow through a respective transition duct 26 to the turbine section 18 where the combustion products are expanded to provide rotation of a turbine rotor 28 as shown in FIG. 1.

Figure 2:
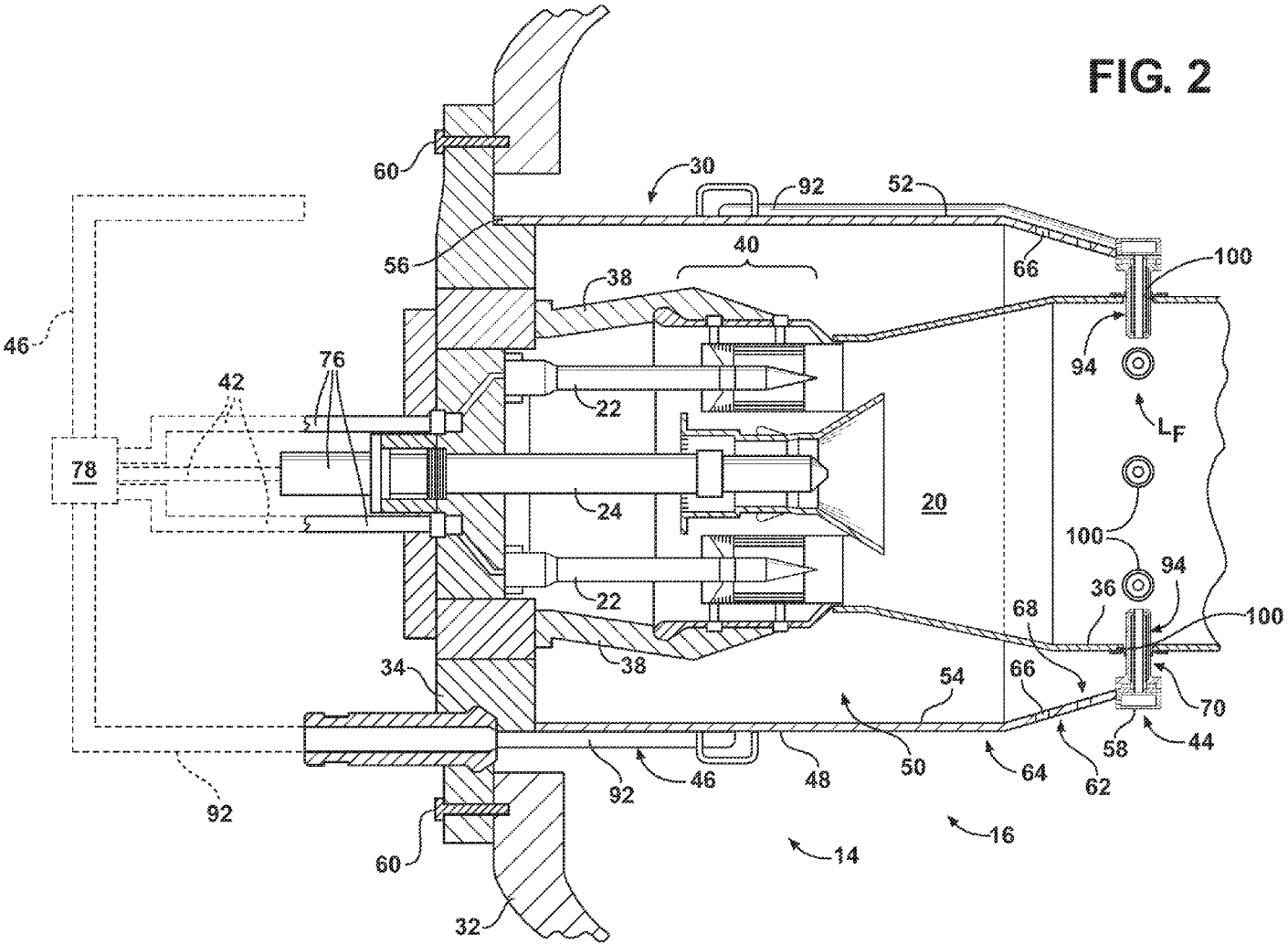
FIG. 2 is a side cross sectional view of a combustor apparatus incorporating a fuel injection system including a plurality of fuel injectors according to an embodiment of the invention.

Referring to FIG. 2, one of the combustor apparatuses 16 of the combustion section 14, which, in the embodiment shown, comprises a can-annular combustion section 14, is shown. Each of the plurality of combustor apparatuses 16 forming part of the combustion section 14 may be constructed in the same manner as the combustor apparatus 16 illustrated in FIG. 2.

The combustor apparatus 16 comprises a flow sleeve or combustor shell 30 coupled to an outer casing 32 of the gas turbine engine 10 via a cover plate 34, see FIG. 2. The combustor apparatus 16 further comprises a liner 36 coupled to the cover plate 34 via supports 38, a first fuel injection system 40 comprising main and pilot fuel injectors 22, 24, first fuel supply structure 42, a second fuel injection system 44, and second fuel supply structure 46.

The flow sleeve 30 may comprise an annular sleeve wall 48. An air flow passage 50 is defined between the sleeve wall 48 and the liner 36 and extends up to the cover plate 34. The sleeve wall 48 includes a radially outer surface 52, a radially inner surface 54, a forward end 56, and an aft end 58 opposite the forward end 56. The forward end 56 is affixed to the cover plate 34 of the engine 10, i.e., with bolts (not shown). The cover plate 34 is coupled to the outer casing 32 via bolts 60. The aft end 58 in the embodiment shown is coupled to the second fuel injection system 44.

The sleeve wall 48 may include a radially inwardly tapered portion 62, which, in the illustrated embodiment, includes the aft end 58, see FIG. 2. The tapered portion 62 may be less stiff than an adjacent main portion 64 of the sleeve wall 48. The reduction in stiffness of the tapered portion 62 may result by forming the tapered portion 62 with a thickness less than a thickness of the main portion 64 or by forming the tapered portion 62 from a material that is less resistant to deformation than a material used to form the main portion 64. The reduction in stiffness of the tapered portion 62 may also result from the formation of a plurality of apertures 66 in the tapered portion 62, which apertures 66 define a first inlet 68 for compressed air to enter into the air flow passage 50. A second inlet 70 into the air flow passage 50 is defined by a gap between the second fuel injection system 44 and the liner 36. Compressed air generated in the compressor section 12 passes through an exit diffuser 72 (see FIG. 1) and combustor plenum 74 (see FIG. 1) prior to passing through the first and second inlets 68, 70 into the air flow passage 50.

It is understood that the percentage of air that passes into the respective inlets 68, 70 can be configured as desired. For example, 100% of the air may pass into the first inlet 68 defined by the apertures 66, in which case the second inlet 70 would not be necessary, or vice versa, although it is understood that other configurations could exist. The apertures 66 are designed, for example, to condition and/or regulate the flow around the circumference of the sleeve wall 48 such that if it is found that more/less air is needed at a certain circumferential location, then the apertures 66 at that location could be enlarged/reduced in size and apertures 66 in other locations could be reduced/enlarged in size accordingly. It is contemplated that the apertures 66 may be arranged in rows or in a random pattern and, further, may be located elsewhere in the sleeve wall 48.

The first fuel injection system 40 comprises the pilot fuel injector 24 and a plurality of the main fuel injectors 22, all of which are attached to the cover plate 34, see FIG. 2. The first fuel supply structure 42 comprises first fuel inlet tubes 76 coupled to the pilot fuel injector 24 and the main fuel injectors 22 as well as to a fuel source 78. The fuel inlet tubes 76 receive fuel from the fuel source 78 and provide the fuel to the pilot and main fuel injectors 24, 22. The fuel from the pilot and main fuel injectors 24, 22 is mixed with compressed air flowing through the air flow passage 50 and ignited in a main combustion zone 20 within the liner 36 creating combustion products defining hot first working gases.

The second fuel injection system 44 is located downstream from the first fuel injection system 40 and, in the embodiment shown, is coupled to the sleeve wall aft end 58, such as by welding. It is also contemplated that the second fuel injection system 44 may be formed as an integral part of the sleeve wall 48, or may be coupled to structure within the combustor apparatus 16 other than the sleeve wall 48.

Figure 3:
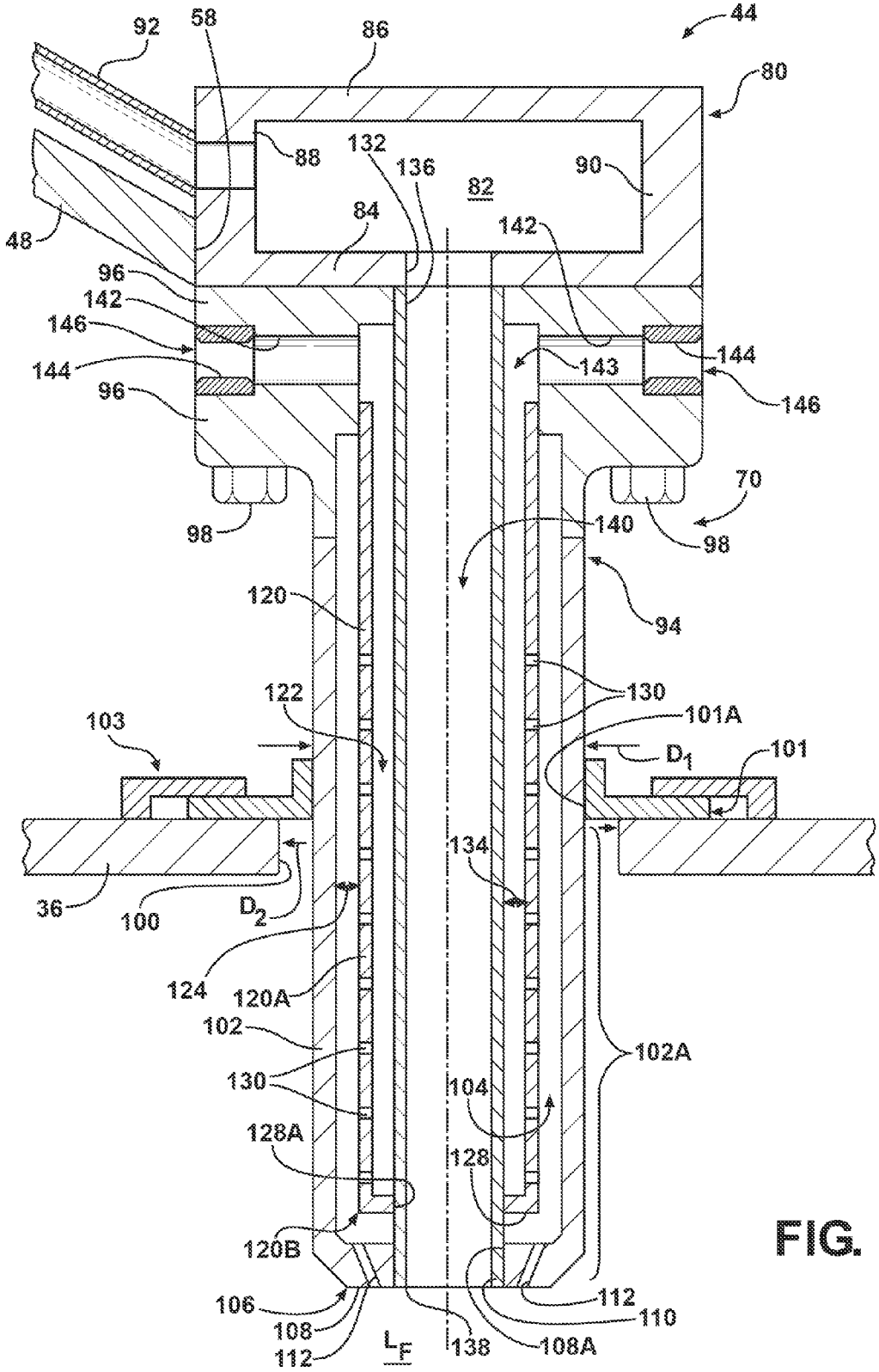
FIG. 3 is an enlarged cross sectional view illustrating one of the fuel injectors shown in FIG. 2.

Referring now to FIG. 3, the second fuel injection system 44 comprises a fuel manifold 80 that defines an inner cavity 82 for receiving fuel. The inner cavity 82 is defined by radially inner and outer walls 84, 86 and first and second axially spaced apart walls 88, 90 of the fuel manifold 80. In the illustrated embodiment, the fuel manifold 80 is annular; hence, the inner cavity 82 in the fuel manifold 80 defines an annular channel.

The second fuel supply structure 46 comprises second fuel supply tubes 92 that communicate with the fuel manifold 80 and the fuel source 78 so as to provide fuel from the fuel source 78 to the second fuel injection system 44. The second fuel supply structure 46 may comprise the same elements and be constructed in the same manner as the second fuel supply structure disclosed in commonly owned U.S. patent application Ser. No. 12/477,397, filed Jun. 3, 2009, entitled COMBUSTOR ASSEMBLY FOR USE IN A GAS TURBINE ENGINE, by Timothy A. Fox, et al., the entire disclosure of which is hereby incorporated by reference herein. It is noted that the second fuel supply structure 46 is located adjacent the outer surface 52 of the sleeve wall 48 and, hence, is protected from the high velocity compressed air passing into and through the air flow passage 50.

The fuel injection system 44 further comprises a plurality of fuel injectors 94 that extend radially inwardly from the fuel manifold 80 and define a fuel dispensing structure. The fuel dispensing structure may be defined by one or a plurality of the fuel injectors 94. The fuel injectors 94 in the embodiment shown are substantially equally spaced in the circumferential direction, although the fuel injectors 94 may be configured in other patterns as desired, such as, for example, a random pattern. It is noted that the number, size, and location of the fuel injectors 94 may vary depending on the particular configuration of the combustor apparatus 16 and the amount of fuel to be injected by the second fuel injection system 44.

As shown in FIG. 3, the fuel injectors 94 each comprise a radially outer base wall 96 that engages the radially inner wall 84 of the fuel manifold 80. The fuel injectors 94 may be coupled to the fuel manifold 80 using any suitable method, such as with bolts 98 extending through bores (not shown) in the base wall 96 that are received by threaded bores (not shown) in the radially inner wall 84 of the fuel manifold 80, welding, etc.

Referring additionally to FIG. 2, each fuel injector 94 extends through a corresponding one of a plurality of openings 100 formed in the liner 36 so as to inject fuel into the inner volume of the liner 36 at a location $L_F$ that is downstream from the main combustion zone 20. In the illustrated embodiment, each liner opening 100 is larger in size than an outer peripheral dimension of its corresponding fuel injector 94. For example, the fuel injectors 94 in the embodiment shown are generally cylindrical in shape and comprise generally circular cross sections having a diameter $D_1$, see FIG. 3. Diameters $D_2$ of the corresponding liner openings 100 are larger than the fuel injector diameters $D_1$. Optionally, as shown in FIG. 3, seal members 101 may be provided for limiting leakage through the oversized apertures 100. The seal members 101 each comprise a bore 101A for receiving a corresponding fuel injector 94. While not specifically shown in the drawings, the size of the bore 101A may be slightly larger than the diameter $D_1$ of the injector 94 such that little or no hot working gases pass between the injector 94 and the seal member 101. However, the bore size must be large enough to accommodate radial movement of its corresponding injector 94. The seal member 101 is movably or slidably coupled to the liner 36 so as to allow it to move with its fuel injector 94 relative to the liner 36. One or more clips 103 are fixed to the liner 36 for receiving edges of the seal member 101. The clips 103 capture the seal member 101 so as to couple it to the liner 36, yet allow the seal member 101 to move relative to the liner 36. Additional details in connection with the seal members 101 can be found in the above reference patent application Ser. No. 12/477,397, entitled, COMBUSTOR ASSEMBLY FOR USE IN A GAS TURBINE ENGINE.

A single fuel injector 94 is illustrated in FIG. 3, it being understood that the other fuel injectors 94 of the second fuel injection system 44 may be substantially identical to the fuel injector 94 described herein and illustrated in FIG. 3.

The fuel injector 94 comprises an outer wall 102, which, in the embodiment shown, extends from the injector base wall 96 to and through the corresponding opening 100 in the liner 36. The outer wall 102 extends to a radial location that is radially inward from the liner 36 such that a portion 102A of the outer wall 102 is located in the inner volume of the liner 36. The outer wall 102 in the embodiment shown comprises a generally cylindrical wall that defines an interior volume 104 therein.

A distal end 106 of the outer wall 102 comprises a radially inner section 108 having a generally centrally located inner bore 108A, which receives an inner wall 110 of the fuel injector 94, which inner wall 110 will be discussed in detail herein. The inner section 108 engages the inner wall 110, see FIG. 3. The outer wall 102 further includes at least one opening 112 formed adjacent the inner bore 108A, and, in the embodiment shown, the outer wall 102 comprises a plurality of openings 112 formed in the radially inner section 108 about the inner bore 108A.

An intermediate wall 120 of the fuel injector 94 is disposed in the interior volume 104 of the outer wall 102 and extends from the injector base wall 96 to a location that is radially spaced and outward from the radially inner section 108 of the outer wall 102. The intermediate wall 120 in the embodiment shown comprises a generally cylindrical section 120A and a distal end section 120B that define an internal volume 122 therein. The intermediate wall 120 is spaced from the outer wall 102 such that a first gap 124 is formed between the outer wall 102 and the intermediate wall 120. The intermediate wall 120 and the outer wall 102 in the embodiment shown are concentric with each other, such that the first gap 124 defines a cylindrical-shaped gap extending in the radial direction.

The distal end section 120B of the intermediate wall 120 in the embodiment shown comprises a bore 128A, which receives the inner wall 110 of the fuel injector 94. The distal end section 120B engages the inner wall 110, see FIG. 3. A plurality of apertures 130 formed in the intermediate wall cylindrical section 120A permit a cooling fluid to flow therethrough into the first gap 124, as will be described in detail herein. At least some of the apertures 130 are located radially inward from a radial location where the fuel injector 94 passes through the opening 100 in the liner 36.

The inner wall 110 of the fuel injector 94 is disposed in the internal volume 122 of the intermediate wall 120 and extends from the radially inner wall 84 of the fuel manifold to the radially inner section 108 of the outer wall 102. The inner wall 110 communicates with an opening 132 formed in the radially inner wall 84 of the fuel manifold 80. The inner wall 110 is generally cylindrical and spaced from the intermediate wall 120 such that a second gap 134 is formed between the intermediate wall 120 and the inner wall 110. The inner wall 110 and the intermediate wall 120 in the embodiment shown are concentric with each other, such that the second gap 134 defines a cylindrical-shaped gap extending in the radial direction. The second gap 134 receives cooling fluid that cools the fuel injector 94, as will be described in detail herein.

The inner wall 110 defines a radially extending passageway 140 having an entrance and exit 136, 138, respectively, which passageway 140 communicates with the fuel manifold inner cavity 82 through which fuel passes from the fuel manifold inner cavity 82 into, through, and out from the fuel injector 94 into the inner volume of the liner 36. The fuel exits the fuel injector 94 through the exit 138 into the location $L_F$, which, as noted above, is downstream from the main combustion zone 20. The exit 138 defines a fuel injection port for injecting the fuel from the passageway 140 into the liner inner volume.

As shown in FIG. 3, cooling fluid passages 142 are formed in the base wall 96 of the fuel injector 94. The cooling fluid passages 142 are in fluid communication with an annular gap 143 formed in the base wall 96 of the fuel injector 94, which, in turn, is in fluid communication with the second gap 134 between the intermediate and inner walls 120, 110. The cooling fluid passages 142 receive cooling fluid, i.e., compressor discharge air, from the combustor plenum 74, which flows therethrough into the annular and second gaps 143 and 134, where the cooling fluid provides convective cooling to the intermediate wall 120 as it flows within the second gap 134. In the embodiment shown, the cooling fluid passages 142 each include an orifice 144 at an entrance 146 thereof, which orifice 146 includes a diameter that may be sized to either increase or decrease the volume of flow therethrough as desired. It is noted that, while two cooling fluid passages 142 are illustrated in FIG. 3, the fuel injector 94 may include additional or fewer cooling fluid passages 94 to control the flow of the cooling fluid into the annular and second gaps 143 and 134. It is also noted that the cooling fluid flowing in the second gap 134 may also provide convective cooling for the inner wall 110. However, since the fuel that passes through the passageway 140 is typically cooler than the cooling fluid, the fuel provides most of the cooling of the inner wall 110 when the fuel is being injected by the second fuel injection system 44.

In addition to providing convective cooling to at least the intermediate wall 120, the cooling fluid flows through the apertures 130 formed in the intermediate wall 120 and into the first gap 124, where the cooling fluid contacts the outer wall 102 to provide impingement cooling to the outer wall 102. Further, the cooling fluid in the first gap 124 provides convective cooling to the outer wall 102 as it flows within the first gap 124. Upon reaching the openings 112 in the radially inner section 108 of the outer wall 102, the cooling fluid is introduced into the inner volume of the liner 36 where the cooling fluid is mixed with the combustion products and passes into the turbine section 18 of the engine 10 along with the combustion products.

It is noted that, due to the high temperatures within the inner volume of the liner 36, the outer wall 102 is typically at a much higher temperature than both the intermediate wall 120 and the cooling fluid flowing through the first gap 124. As the cooling fluid removes heat from the outer wall 102 by way of impingement and convective cooling as discussed above, the cooling fluid may heat up to a temperature that is higher than the temperature of the intermediate wall 120, in which case the cooling fluid flowing through the first gap 124 may transfer heat to the intermediate wall 120. However, since the cooling fluid flowing in the second gap 134 is typically at a lower temperature than both the cooling fluid in the first gap 124 and the intermediate wall 120, the cooling fluid flowing in the second gap 134, in addition to the cooling fluid flowing through the apertures 130, removes heat from the intermediate wall 120 to at least partially offset the heating of the intermediate wall 120 effected by the cooling fluid flowing through the first gap 124. It is noted that the intermediate wall 120 is formed from a material that is tolerant of the temperature increase effected by the cooling fluid flowing through the first gap 124.

During operation of the engine 10, the cooling fluid effectively cools the fuel injectors 94, which fuel injectors 94 each include a substantial portion that is exposed to the combustion products in the liner inner volume, i.e., a portion of the fuel injector 94 corresponding to the portion 102A of the outer wall 102 that is located in the liner inner volume. It is noted that the fuel injectors 94 may additionally be cooled by the fuel passing through the passageways 140 defined by the injector inner walls 110. However, fuel is only provided to the second fuel injection system 44 during certain operating conditions of the engine 10, and hence, cooling of the fuel injectors 94 by the fuel is not always available. The cooling of the fuel injectors 94 provided by the cooling fluid may be constantly provided to the fuel injectors 94, i.e., during all operating conditions of the engine 10, thus reducing the chances of damage to the fuel injectors 94 as a result of overheating. Even when fuel is being provided by the second fuel injection system 44, in which case the fuel provides cooling to the fuel injectors 94, the cooling fluid may provide additional cooling to the fuel injectors 94 to further reduce the chances of damage to the fuel injectors 94 as a result of overheating.

It is noted that injecting fuel at two axially spaced apart fuel injection locations, i.e., via the first fuel injection system 40 and the second fuel injection system 44, may reduce the production of NOx by the combustor apparatus 16. For example, since a significant portion of the fuel, e.g., about 15-30% of the total fuel supplied by the first fuel injection system 40 and the second fuel injection system 44, is injected at a location downstream of the main combustion zone 20, i.e., by the second fuel injection system 44, the amount of time that second combustion products generated by the second fuel injection system 44 are at a high temperature is reduced as compared to the first combustion products resulting from the ignition of fuel injected by the first fuel injection system 40. Since NOx production is increased by the elapsed time the combustion products are at a high combustion temperature, combusting a portion of the fuel downstream of the main combustion zone 20 reduces the time the combustion products resulting from the second portion of fuel provided by the second fuel injection system 44 are at a high temperature, such that the amount of NOx produced by the combustor apparatus 16 may be reduced.

Figure 4:
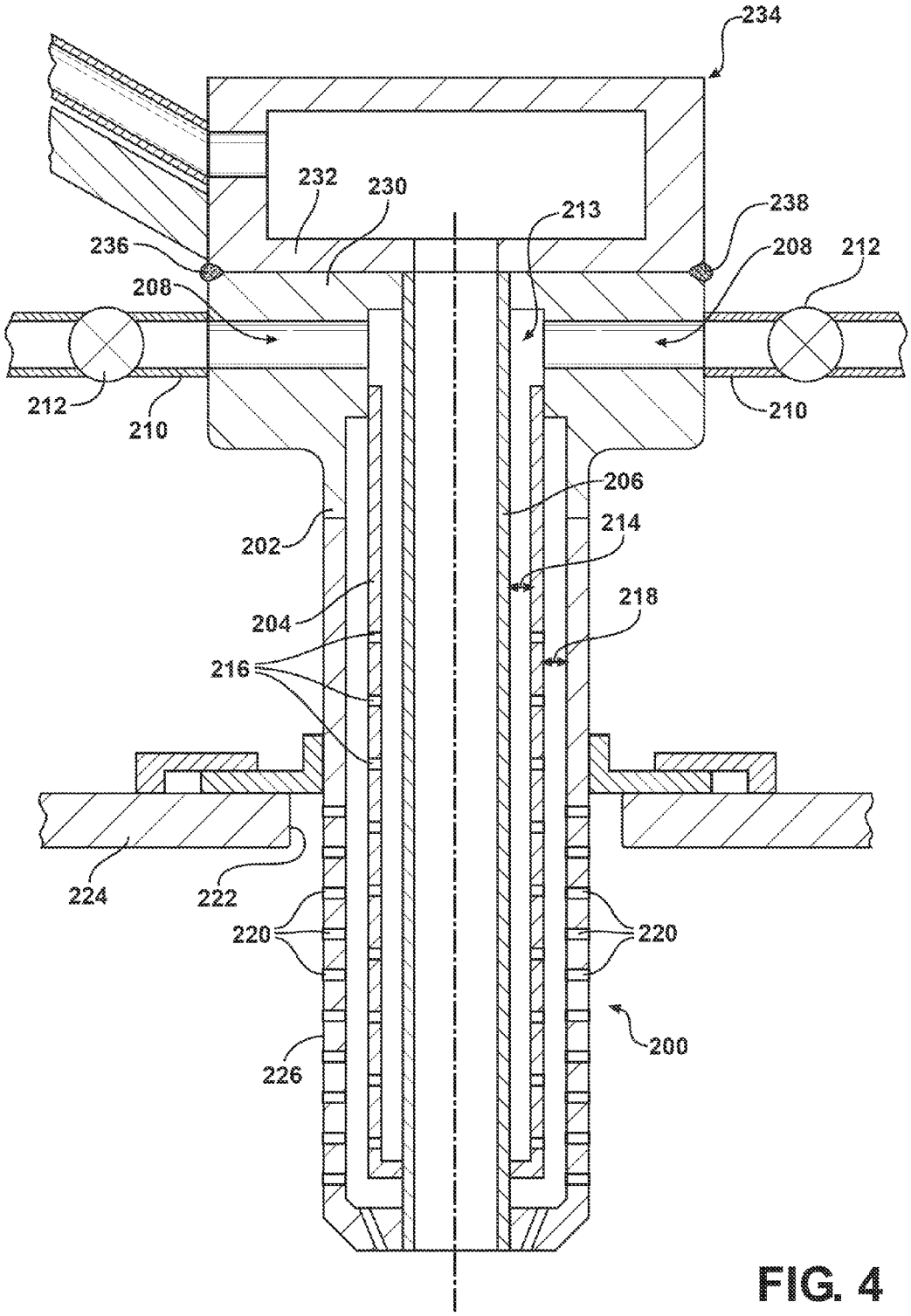
FIG. 4 is an enlarged cross sectional view illustrating a fuel injector according to another embodiment of the invention.

In one alternate embodiment illustrated in FIG. 4, a fuel injector 200 comprises an outer wall 202, an intermediate wall 204, and an inner wall 206.

Cooling fluid passages 208 that permit cooling fluid to flow into the fuel injector 200 for providing cooling thereto according to this embodiment communicate with tubes 210 that extend to or through the cooling fluid passages 208. The tubes 210 may each include a valve 212 for controlling the flow of cooling fluid into the fuel injector 200. The valves 212 may be controlled by a controller (not shown) associated with a combustor apparatus in which the fuel injector 200 is employed. The cooling fluid according to this embodiment may comprise compressor discharge air, e.g., from a combustor plenum (not shown in this embodiment), or may comprise some other type of cooling fluid provided to the fuel injector 200 through the tubes 210.

As with the embodiment described above with reference to FIGS. 1-3, the cooling fluid flows through the cooling fluid passages 208 into an annular gap 213 that communicates with a second gap 214 that is located between the intermediate and inner walls 204, 206. While flowing through the second gap 214, the cooling fluid provides cooling to the intermediate wall 204, and possibly to the inner wall 206 as discussed above. The cooling fluid flows through apertures 216 formed in the intermediate wall 204 and into a first gap 218 located between the outer and intermediate walls 202, 204. As the cooling fluid passes into the first gap 218, the cooling fluid contacts the outer wall 202 to provide impingement cooling to the outer wall 202. Further, the cooling fluid in the first gap 218 provides convective cooling to the outer wall 202 as it flows within the first gap 218.

In this embodiment, a plurality of film cooling holes 220 are formed in the outer wall 202. At least some of the film cooling holes 220 are formed in the outer wall 202 radially inwardly from a radial location wherein the fuel injector 200 passes through an opening 222 formed in a liner 224. The film cooling holes 220 permit cooling air to flow therethrough from the first gap 218 to provide film cooling to an outer surface 226 of the outer wall 202.

In this embodiment, a base wall 230 of the fuel injector 200 is welded to a radially inner wall 232 of a fuel manifold 234, i.e., at welding locations 236, 238, to secure the fuel injector 200 to the fuel manifold 234, which fuel manifold 234 is used to supply fuel to the fuel injector 200, as discussed above.

Remaining structure of the fuel injector 200 according to this embodiment is substantially the same as the fuel injector 94 of FIGS. 1-3.

Figure 5:
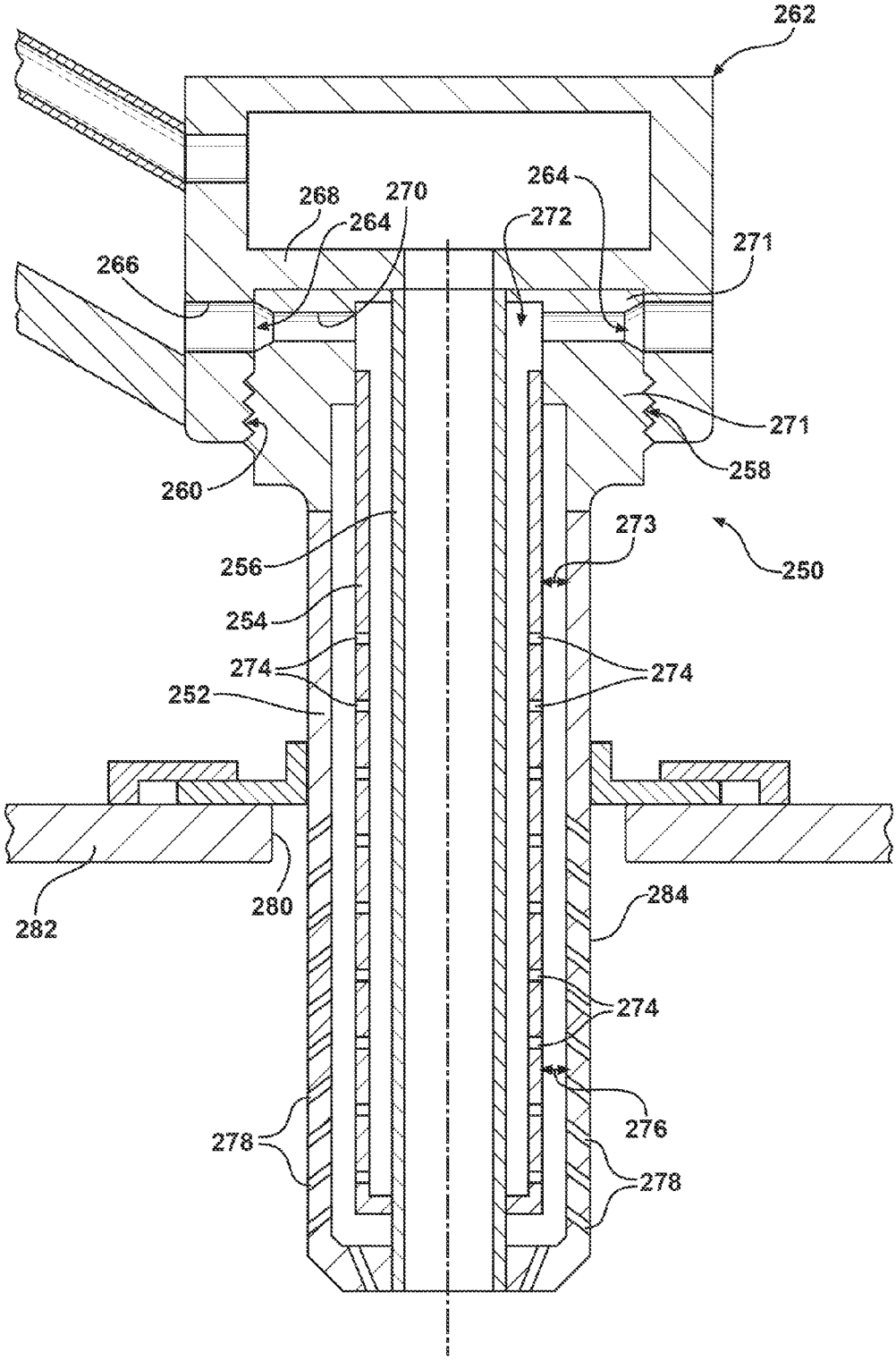
FIG. 5 is an enlarged cross sectional view illustrating a fuel injector according to yet another embodiment of the invention.

In another alternate embodiment illustrated in FIG. 5, a fuel injector 250 comprises an outer wall 252, an intermediate wall 254, and an inner wall 256.

The fuel injector 250 according to this embodiment includes a radially outer threaded section 258, which threaded section 258 is threadedly received in a corresponding threaded section 260 of a fuel manifold 262 to which the fuel injector 250 is affixed.

Cooling fluid passages 264 according to this embodiment comprise first passages 266 formed in a radially inner wall 268 of the fuel manifold 262 and also comprise second passages 270 formed in a base wall 271 of the fuel injector 250, which base wall 271 includes the threaded section 258. The cooling fluid passages 264 permit cooling fluid to flow into the fuel injector 250 for providing cooling thereto. The cooling fluid according to this embodiment may comprise compressor discharge air, e.g., from a combustor plenum (not shown in this embodiment).

As with the embodiments described above with reference to FIGS. 1-4, the cooling fluid flows through the cooling fluid passages 264 into an annular gap 272 and then into a second gap 273 that is located between the intermediate and inner walls 254, 256. While flowing through the second gap 273, the cooling fluid provides cooling to the intermediate wall 254, and possibly to the inner wall 256 as discussed above. The cooling fluid flows through apertures 274 formed in the intermediate wall 254 and into a first gap 276 located between the outer and intermediate walls 252, 254. As the cooling fluid passes into the first gap 276, the cooling fluid contacts the outer wall 252 to provide impingement cooling to the outer wall 252. Further, the cooling fluid in the first gap 276 provides convective cooling to the outer wall 252 as it flows within the first gap 276.

In this embodiment, a plurality of film cooling holes 278 is formed in the outer wall 252. At least some of the film cooling holes 278 are formed in the outer wall 252 radially inwardly from a radial location wherein the fuel injector 250 passes through an opening 280 formed in a liner 282. The film cooling holes 278 permit cooling air to flow therethrough from the first gap 276 to provide film cooling to an outer surface 284 of the outer wall 252. In this embodiment, the film cooling holes 278 are angled in a radial direction so as to release cooling fluid in a direction that includes a component in the radial direction.

Remaining structure of the fuel injector 250 according to this embodiment is substantially the same as the fuel injector 94 of FIGS. 1-3.

Figure 6:
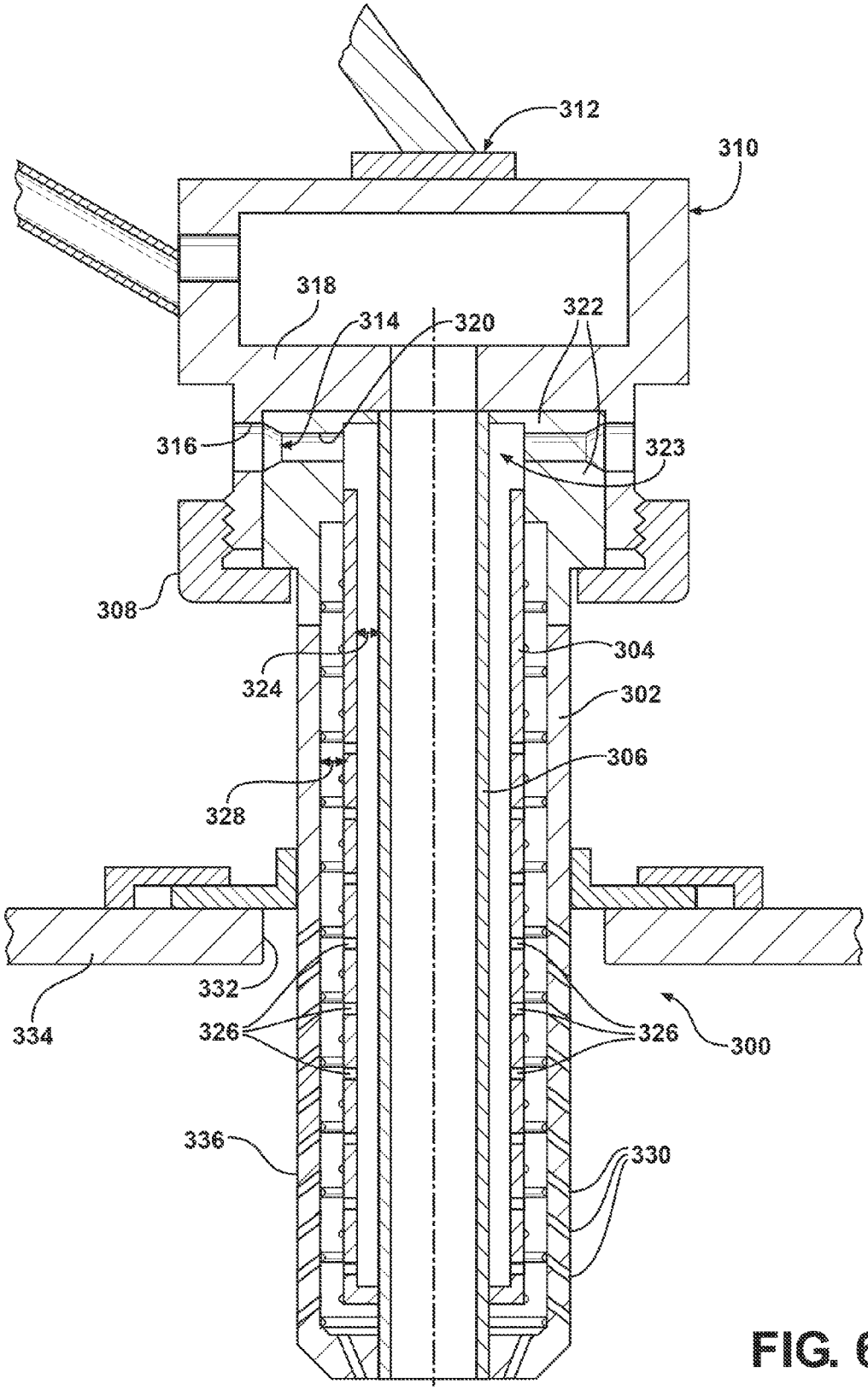
FIG. 6 is an enlarged cross sectional view illustrating a fuel injector according to yet another embodiment of the invention.

In yet another alternate embodiment illustrated in FIG. 6, a fuel injector 300 comprises an outer wall 302, an intermediate wall 304, and an inner wall 306.

In this embodiment, the fuel injector 300 is associated with a coupling structure 308, illustrated in FIG. 6 as a nut, which couples the fuel injector 300 to a fuel manifold 310, which fuel manifold 310 delivers fuel to the fuel injector 300.

The fuel manifold 310 according to this embodiment is not directly affixed to a flow sleeve as in the embodiments described above for FIGS. 1-5. Rather, the fuel manifold 310 is structurally affixed to a mounting structure 312 that is coupled to other structure within a combustor apparatus in which the fuel manifold 310 and the fuel injector 300 are employed. Suitable structures to which the mounting structure 312 is coupled include an engine casing, a flow sleeve, a cover plate (none of which are illustrated in this embodiment), or other structure within the combustor apparatus capable of structurally supporting the fuel manifold 310 and the fuel injector 300.

Cooling fluid passages 314 according to this embodiment comprise first passages 316 formed in a radially inner wall 318 of the fuel manifold 310 and also comprise second passages 320 formed in a base wall 322 of the fuel injector 300. The cooling fluid passages 314 permit cooling fluid to flow into the fuel injector 300 for providing cooling thereto. The cooling fluid according to this embodiment may comprise compressor discharge air, e.g., from a combustor plenum (not shown in this embodiment).

As with the embodiments described above with reference to FIGS. 1-5, the cooling fluid flows through the cooling fluid passages 314 into an annular gap 323 and into second gap 324 that is located between the intermediate and inner walls 304, 306. While flowing through the second gap 324, the cooling fluid provides cooling to the intermediate wall 304, and possibly to the inner wall 306 as discussed above. The cooling fluid flows through apertures 326 formed in the intermediate wall 304 and into a first gap 328 located between the outer and intermediate walls 302, 304. As the cooling fluid passes into the first gap 328, the cooling fluid contacts the outer wall 302 to provide impingement cooling to the outer wall 302. Further, the cooling fluid in the first gap 328 provides convective cooling to the outer wall 302 as it flows within the first gap 328.

A plurality of film cooling holes 330 is formed in the outer wall 302. At least some of the film cooling holes 330 are formed in the outer wall 302 radially inwardly from a radial location wherein the fuel injector 300 passes through an opening 332 formed in a liner 334. The film cooling holes 330 permit cooling air to flow therethrough from the first gap 328 to provide film cooling to an outer surface 336 of the outer wall 302. The film cooling holes 330 in this embodiment are angled in a radial direction so as to release cooling fluid in a direction that includes a component in the radial direction.

Figure 6A:
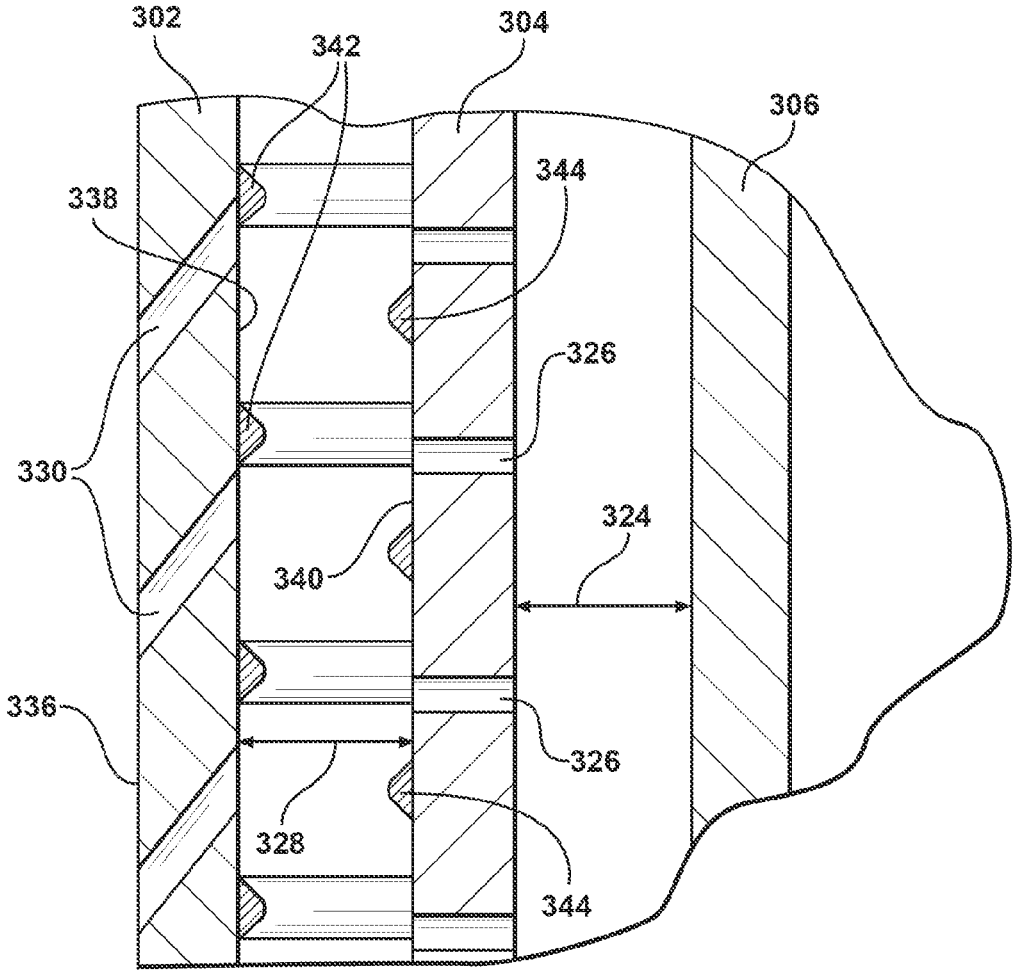
FIG. 6A is an enlarged view illustrating a portion of the fuel injector illustrated in FIG. 6.

Referring to FIG. 6A, in this embodiment an inner surface 338 of the outer wall 302 and an outer surface 340 of the intermediate wall 304 include respective turbulating structures 342, 344. The turbulating structures 342, 344 in the embodiment shown comprise ring-shaped ribs that protrude from the respective surfaces 338, 340 into the first gap 328. The turbulating structures 342, 344 effect a turbulation of the cooling fluid flowing in the first gap 328. The turbulation of the cooling fluid increases the cooling provided to the outer wall 302 by creating a turbulence effect, which turbulence effect increases the heat transfer coefficient of the cooling fluid acting on the outer wall 302. It is noted that the turbulation of the cooling fluid could be achieved by either the turbulating structures 342 on the outer wall 302 or the turbulating structures 344 on the inner wall 304, i.e., turbulating structures 342, 344 on both the outer and intermediate walls 302, 304 are not necessary. It is also noted that other types of turbulating structures may be used.

Remaining structure of the fuel injector 300 according to this embodiment is substantially the same as the fuel injector 94 of FIGS. 1-3.

It is noted that, while the fuel manifolds 80, 234, and 262 illustrated in FIGS. 1-5 are each mounted to a flow sleeve, these fuel manifolds 80, 234, and 262 may be mounted to other structure within their respective combustor apparatuses that is capable of structurally supporting the fuel manifolds 80, 234, and 262 and their associated fuel injectors 94, 200, 250. For example, the fuel manifolds 80, 234, and 262 may include mounting structures, such as the mounting structure 312 illustrated in FIG. 6, wherein the mounting structures may couple the fuel manifolds 80, 234, and 262 to an engine casing, a flow sleeve, a cover plate, etc. Additionally, the fuel manifold 310 illustrated in FIG. 6 could be mounted directed to a flow sleeve.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fuel injector for use in a combustor apparatus of a gas turbine engine, the fuel injector extending radially inward through an opening formed in a liner and into an inner volume of the liner downstream from a main combustion zone, the fuel injector comprising:

an outer wall defining an interior volume therein and including at least one opening formed therein, at least a portion of said outer wall located in the inner volume of the liner;

an intermediate wall disposed in said outer wall interior volume and spaced from said outer wall such that a first gap is formed between said outer wall and said intermediate wall, said intermediate wall defining an internal volume and including at least one aperture formed therein;

an inner wall disposed in said intermediate wall internal volume and spaced from said intermediate wall such that a second gap is formed between said intermediate wall and said inner wall, said second gap receiving cooling fluid that cools the fuel injector, said inner wall defining a passageway therein that receives fuel and delivers said fuel to the inner volume of the liner downstream from the main combustion zone defined by the liner; and wherein said cooling fluid in said second gap:

provides convective cooling to said intermediate wall as said cooling fluid flows within said second gap;

flows through said at least one aperture in said intermediate wall into said first gap where said cooling fluid provides impingement cooling to said outer wall and provides convective cooling to said outer wall as it said cooling fluid flows within said first gap; and passes into the inner volume of the liner via said at least one opening in said outer wall.

2. The fuel injector of claim 1, wherein:

said outer wall, said intermediate wall, and said inner wall are each concentric with one another; and said first and second gaps comprise cylindrical-shaped gaps extending in a radial direction.

3. The fuel injector of claim 1, wherein a distal end of said inner wall defines a fuel injection port in fluid communication with said passageway, said fuel injection port delivers said fuel to the inner volume of the liner.

4. The fuel injector of claim 1, wherein said outer wall comprises a plurality of film cooling holes formed therein, said film cooling holes permitting cooling fluid flowing in said first gap to flow therethrough to provide film cooling to an outer surface of said outer wall.

5. The fuel injector of claim 4, wherein at least one of said film cooling holes is angled in a radial direction so as to release cooling fluid in a direction that includes a component in the radial direction.

6. The fuel injector of claim 4, wherein said film cooling holes are formed in said outer wall at locations radially inwardly from a radial location where the fuel injector extends through the opening in the liner.

7. The fuel injector of claim 1, wherein at least one of: an inner surface of said outer wall and an outer surface of said intermediate wall includes a plurality of turbulating structures that turbulate said cooling fluid flowing in said first gap.

8. The fuel injector of claim 1, further comprising a valve that controls a flow of said cooling fluid into said second gap.

9. A fuel injection system for use in a combustor apparatus of a gas turbine engine, the fuel injection system for delivering fuel into an inner volume of a liner at a location downstream from a main combustion zone defined in the inner volume of the liner, the fuel injection system comprising:

a fuel manifold that receives fuel to be distributed into the inner volume of the liner;

a plurality of fuel injectors in fluid communication with said fuel manifold, said fuel injectors extending radially inward from said fuel manifold through corresponding openings formed in the liner, wherein said fuel injectors distribute said fuel from said fuel manifold into the inner volume of the liner downstream from the main combustion zone, each said fuel injector comprising:

an outer wall defining an interior volume therein and including at least one opening formed therein, at least a portion of said outer wall located in the inner volume of the liner;

an intermediate wall disposed in said outer wall interior volume and spaced from said outer wall such that a first gap is formed between said outer wall and said intermediate wall, said intermediate wall defining an internal volume and including at least one aperture formed therein;

an inner wall disposed in said intermediate wall internal volume and spaced from said intermediate wall such that a second gap is formed between said intermediate wall and said inner wall, said second gap receiving cooling fluid that cools said fuel injector, said inner wall defining a passageway therein that receives said fuel from said fuel manifold and delivers said fuel to the inner volume of the liner downstream from the main combustion zone; and wherein said cooling fluid in said second gap:

provides convective cooling to said intermediate wall as said cooling fluid flows within said second gap;

flows through said at least one aperture in said intermediate wall into said first gap where said cooling fluid provides convective cooling to said outer wall as said cooling fluid flows within said first gap; and passes into the inner volume of the liner via said at least one opening in said outer wall.

10. The fuel injection system of claim 9, wherein:

said outer wall, said intermediate wall, and said inner wall are each concentric with one another; and said first and second gaps comprise cylindrical-shaped gaps extending in a radial direction.

11. The fuel injection system of claim 9, wherein a distal end of said inner wall of each of said fuel injectors defines a fuel injection port in fluid communication with said passageway of the respective fuel injector, said fuel injection port delivers said fuel to the inner volume of the liner.

12. The fuel injection system of claim 9, wherein said outer wall of each of said fuel injectors comprises a plurality of film cooling holes formed therein at locations radially inwardly from radial locations where the respective fuel injector extends through the corresponding opening in the liner, said film cooling holes permitting cooling fluid flowing in said first gap of the respective fuel injector to flow therethrough to provide film cooling to an outer surface of said outer wall of the respective fuel injector.

13. The fuel injection system of claim 9, further comprising at least one valve that controls a flow of said cooling fluid into said second gaps of said fuel injectors.

14. The fuel injection system of claim 9, wherein said cooling fluid in said second gap of each of said fuel injectors flows through said at least one aperture in said intermediate wall into said first gap where said cooling fluid further provides impingement cooling to said outer wall.

15. A combustor apparatus for use in a gas turbine engine comprising:

a liner comprising an inner volume, wherein a portion of said inner volume defines a main combustion zone;

a flow sleeve for receiving compressed air, said flow sleeve positioned radially outward from said liner;

a first fuel injection system associated with said flow sleeve;

a first fuel supply structure in fluid communication with a source of fuel for delivering fuel from said source of fuel to said first fuel injection system;

a second fuel injection system associated with Said liner downstream from said main combustion zone;

a second fuel supply structure in fluid communication with said source of fuel for delivering fuel from said source of fuel to said second fuel injection system;

said second fuel injection system providing fuel into said inner volume of said liner at a location downstream from said main combustion zone, said second fuel injection system comprising;

a fuel manifold that receives fuel from said second fuel supply structure;

a plurality of fuel injectors in fluid communication with said fuel manifold, said fuel injectors extending through corresponding openings in said liner into said inner volume of said liner, wherein said fuel injectors distribute said fuel from said fuel manifold into said inner volume of said liner downstream from said main combustion zone, each said fuel injector comprising:

an outer wall defining an interior volume therein and including at least one opening formed therein, at least a portion of said outer wall located in said inner volume of said liner;

an intermediate wall disposed in said outer wall interior volume and spaced from said outer wall such that a first gap is formed between said outer wall and said intermediate wall, said intermediate wall defining an internal volume and including at least one aperture formed therein;

an inner wall disposed in said intermediate wall internal volume and spaced from said intermediate wall such that a second gap is formed between said intermediate wall and said inner wall, said second gap receiving cooling fluid that cools said fuel injector, said inner wall defining a passageway therein that receives said fuel from said fuel manifold and delivers said fuel to said inner volume of said liner downstream from said main combustion zone; and wherein said cooling fluid in said second gap:

provides convective cooling to said intermediate wall as said cooling fluid flows within said second gap;

flows through said at least one aperture in said intermediate wall into said first gap where said cooling fluid provides convective cooling to said outer wall as said cooling fluid flows within said first gap; and passes into the inner volume of the liner via said at least one opening in said outer wall.

16. The combustor apparatus of claim 15, further comprising a plurality of seal members, one for each fuel injector, each said seal member being associated with a respective one of said openings in said liner through which said fuel injectors extend, said seal members limiting leakage through said openings in said liner.

17. The combustor apparatus of claim 15, wherein a distal end of said inner wall of each of said fuel injectors defines a fuel injection port in fluid communication with said passageway of the respective fuel injector, said fuel injection port delivers said fuel to said inner volume of said liner.

18. The combustor apparatus of claim 15, wherein said outer wall of each of said fuel injectors comprises a plurality of film cooling holes formed therein at locations radially inwardly from radial locations where the respective fuel injector extends through said corresponding opening in said liner, said film cooling holes permitting cooling fluid flowing in said first gap of the respective fuel injector to flow therethrough to provide film cooling to an outer surface of said outer wall of the respective fuel injector.

19. The combustor apparatus of claim 15, further comprising at least one valve that controls a flow of said cooling fluid into said second gaps of said fuel injectors.

20. The combustor apparatus of claim 15, wherein said cooling fluid in said second gap of each of said fuel injectors flows through said at least one aperture in said intermediate wall into said first gap where said cooling fluid further provides impingement cooling to said outer wall.

* * * * *